United States Patent [19]

Waters

[11] 3,984,946

[45] Oct. 12, 1976

[54] MOTOR DRIVEN ABRASIVE DEVICE WITH ROTATING, CYLINDRICAL MOTOR DRUM HOUSING

[76] Inventor: Warren W. Waters, Rte. 3, Box 435, Wichita Falls, Tex. 76308

[22] Filed: Oct. 20, 1975

[21] Appl. No.: 624,112

[52] U.S. Cl. ..... 51/170 PT; 418/175

[51] Int. Cl.[2] ..... B24B 23/00

[58] Field of Search ..... 51/170 PT, 170 R, 170 EB, 51/135 BT; 418/175

[56] References Cited

UNITED STATES PATENTS

| | | | |
|---|---|---|---|
| 799,596 | 9/1905 | Elliott | 418/175 |
| 2,810,240 | 10/1957 | Davis et al. | 51/170 PT |
| 3,251,308 | 5/1966 | Dugan | 418/175 |
| 3,304,879 | 2/1967 | Hanson | 418/175 |
| 3,914,905 | 10/1975 | Waters | 51/170 PT |

*Primary Examiner*—James L. Jones, Jr.
*Attorney, Agent, or Firm*—Wayland D. Keith

[57] ABSTRACT

A motor operated abrading device for abrading surfaces, such as vehicle bodies, which device utilizes a cylindrical housing of the motor on which to secure a sheet of abrasive material, so when the cylindrical motor housing is rotated an abrading element is formed, without having to drive the abrading element with chains, gears, belts or the like. The motor will have any suitable source of power, such as electricity or air, so long as the outer housing is cylindrical and rotatable with respect to a stationary shaft. When air is used as the motive power, the air, which is cool, passes through the motor, and will maintain the motor cool as well as the cylindrical drum and the abrasive surface which is mounted thereon. The motor may be used with or without a guide frame to control the abrading element with respect to the surface being abraded. When an air motor is used it has a unique manner of conducting air into and through a non-rotable shaft to the rotating drum, which is driven by an internal motor mechanism. The guide enables contouring concave convex or planar surfaces.

11 Claims, 13 Drawing Figures

MOTOR DRIVEN ABRASIVE DEVICE WITH ROTATING, CYLINDRICAL MOTOR DRUM HOUSING

SUMMARY OF THE INVENTION

This application is co-pending with my application Ser. No. 536,020, filed Dec. 23, 1974, for ABRADING DEVICE, now U.S. Pat. No. 3,914,905, issued Nov. 28, 1975.

The present invention relates to an air or fluid driven abrading device and more particularly to a abrading device in which the outer shell of the air motor rotates and to which shell or cylindrical drum a sheet of abrading material is affixed, which material may be emery cloth, sand paper or fine mesh material treated with an abrasive coating. The present arrangement is particularly advantageous for abrading and contouring dents, scars and the like on vehicle bodies or in sheet metal, which dents and the like have been filled with epoxy material. Heretofore such repairs were made smooth by the use of rasps, and/or motor driven disc sanders. When such methods were used, the body contour had to be eyeballed by the workman for proper smoothness and contour, and required great skill and dexterity.

The present device employs a gauge, which when properly set, will control the cut of the abrading device with great accuracy, both with respect to the depth and to the contour.

PRIOR ART

Various abrading devices have been proposed heretofore, such as disc sanders, rasps and motor driven drum sanders, but these for the most part required much skill, and many were quite time consuming. The prior art reveals the following patents:

| | | |
|---|---|---|
| No. 1 404 342 | Clark | Jan. 24, 1922 |
| No. 1 480 285 | Moore | Jan. 8, 1924 |
| No. 1 841 787 | Carter | June 9, 1932 |
| No. 2 810 240 | Davis et al | Oct. 22, 1957 |
| No. 3 789 552 | Bradbury et al | Feb. 5, 1974 |

OBJECTS OF THE INVENTION

An object of the invention is to provide a motor driven abrading device in which the cylindrical housing of the motor carries a sheet of abrasive material to abrade surfaces.

Another object of the invention is to provide an air driven motor in which the shaft remains stationary and the air is directed therethrough to the driven mechanism within the motor to rotate the cylindrical housing carrying a sheet of abrasive material.

Still another object of the invention is to provide a vane type driving mechanism for an air motor, which has an apertured, stationary shaft through which air is directed to a multiplicity of vanes to drive the cylindrical motor drum housing which carries a sheet of abrasive material.

DETAILED DESCRIPTION OF THE INVENTION

Figure 1:
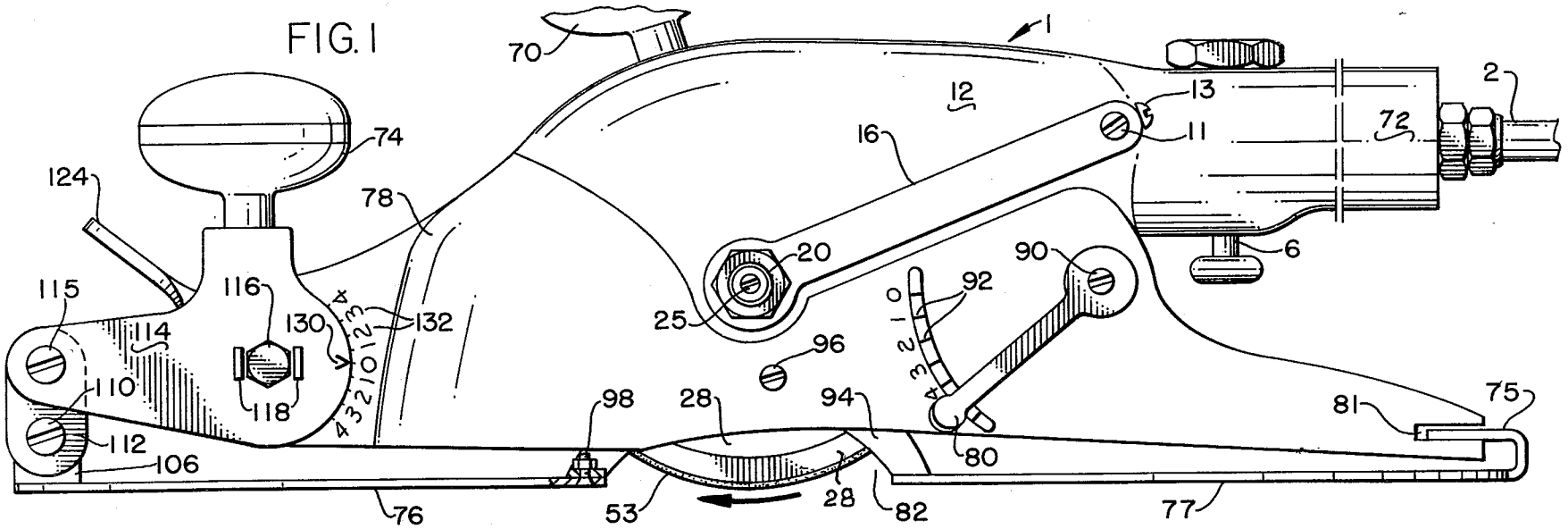
FIG. 1 is a side elevational view of the abrading device, with parts broken away and shown in section and with a fragmentary portion broken away and shown in section to show the manner of connecting one of the guides to an arcuately pivoted member.

With more detailed reference to the drawing, in which like reference characters designate like parts in the several views thereof, the numeral 1 designates generally a motor driven abrading device having a rotating cylindrical motor drum housing 3. The abrading device 1 is preferably air driven by compressed air entering through a hose 2 and passing through passage 4, which passage is formed in the handle 72 of the abrading device, thence through a valve 6 and out through a passage 8 formed in handle 72. The air passes from passage 8 into a passage 10 which is formed in housing 12, thence into passage 14, formed in housing 12, which passage 14 intersects passage 10 so as to direct air downward into conduit 16 which is formed integrally with housing 12, then into annular passage 18 formed therein, which passage 18 surrounds a shaft 20. The shaft 20 extends through the housing 12 and through end plates 28, 32 and drum 3, and which shaft is stationary with respect to the housing. The air will then be directed from the annular passage 18 into cross drilled passage 22 in shaft 20, thence through an axial passage 24 formed in shaft 20, and into another cross drilled passage 34 in shaft 20, and into an annular passage 26 within end plate 28 of the rotatable cylindrical drum housing 3, the other end of the cylindrical drum housing has a plate 32 thereon.

The respective plates 28 and 32 are secured to the rotatable cylindrical drum housing 3 by screws 29 and 33 respectively, and are rotatable therewith. The annular passage 26 in rotatable end plate 28 is interconnected with a cross drilled passage 34, so as to direct air under pressure therethrough and outwardly into radial passage 36 in end plate 28, which radial passage 36 is plugged by a plug as indicated at 38. The passage 36 connects with passages 40 and 42, which are formed in end plate 28, to direct air thereinto and therethrough, under pressure, so as the cylindrical drum housing 3 rotates about stator 44, which stator is keyed to stationary shaft 20 by a key 43, the air under pressure which passes into arcuate passage 42 in end plate 28 is exhausted into vane slots 46 at the innermost ends thereof so as to urge vanes 48, which are slidably mounted therein, outwardly against the inner cylindrical surface 50 of drum housing 3 in fluid tight sealing relation.

Figure 5:
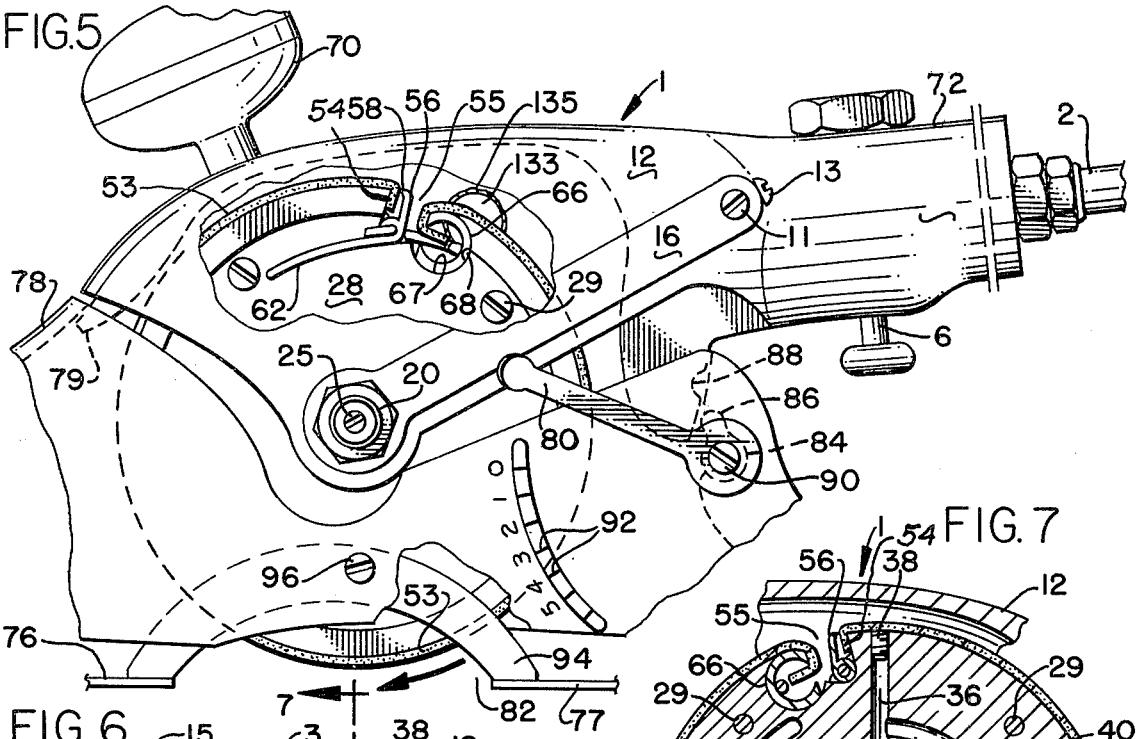
FIG. 5 is a side elevational view, with parts broken away, to show the details of construction, and showing the manner of disassembling the formed portion of the housing and the guide member from the rear portion of the housing which carries the air motor and controls to enable the air driven motor drum abrading device to be used independently of the guide member and of the forward portion of the housing to enable an abrasive sheet of material to be secured to the drum.
Figure 6:
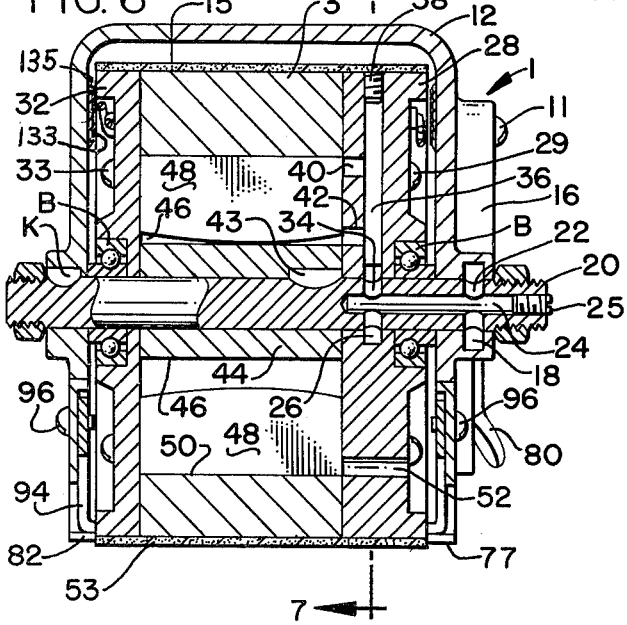
FIG. 6 is a sectional view taken on the line 6—6 of FIG. 4, looking in the direction indicated by the arrows, with parts broken away and with parts shown in elevation.
Figure 7:
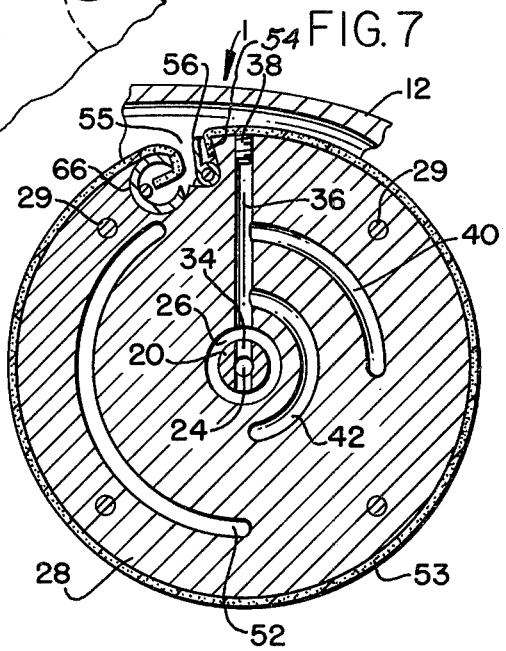
FIG. 7 is a sectional view taken on the line 7—7 of FIG. 6, looking in the direction indicated by the arrows, showing the air inlet ports to the air motor.
Figure 8:
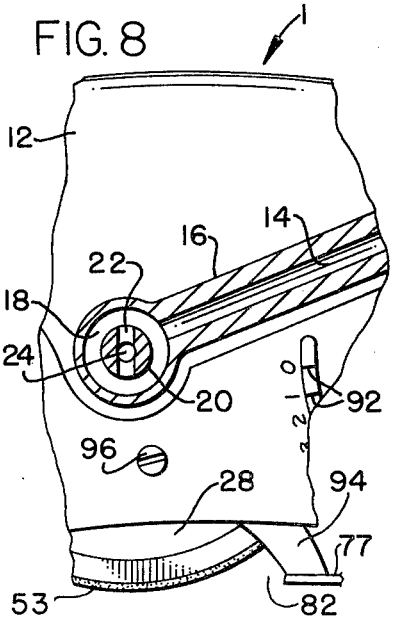
FIG. 8 is a sectional view taken on the line 8—8 of FIG. 3, looking in the direction indicated by the arrows, showing the air passage within the housing leading from the control valve to the stationary hollow shaft which leads to the ports within the motor housing.
Figure 9:
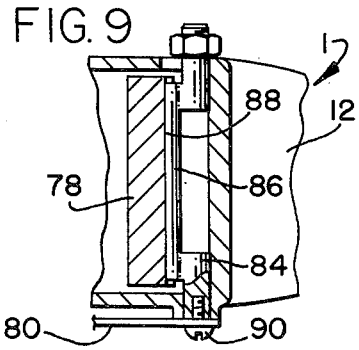
FIG. 9 is a fragmentary sectional view taken on the line 9—9 of FIG. 4, looking in the direction indicated by the arrows, showing a pivoted lever for gauging the movement of the guide member with respect to the drum and also to disengage the forward portion of the housing from the rear portion of the housing to enable the separation of the housing portions.

Simultaneously with the vanes 48 being forced outwardly by air pressure against the inner cylindrical surface 50, air is also directed into the arcuate passage 40 for approximately 90° travel to react against the outwardly extending faces of vanes 48, which will cause the cylindrical motor drum housing 3 to rotate as indicated by the arrow in FIG. 5, with the air exhausting into arcuate slot 52, which will enable the cylindrical drum housing 3 to be rotated, with the air being exhausted through slot 52 to atmosphere.

In order to provide for efficient construction, the passages 10, 16 and 24 are each plugged, at one end, by the respective screws 11, 13 and 25, which passages are drilled so as to direct air in channeled relation, as shown in FIGS. 1, 6, 7, and 8.

Figure 11:
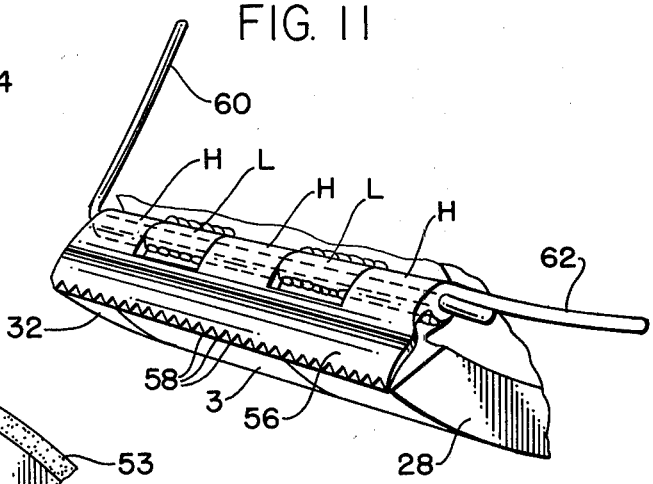
FIG. 11 is a fragmentary perspective view, on an enlrged scale, of a portion of the cylindrical air motor drum housing, showing a hinged spring tensioned, toothed abrading sheet holding device engaging a slotted portion of the cylindrical drum.
Figure 12:
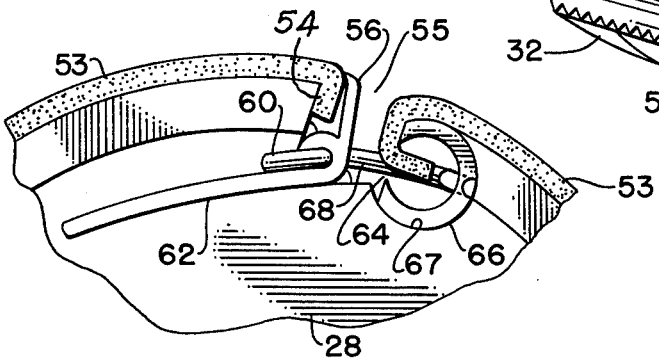
FIG. 12 is an enlarged fragmentary elevational view showing transverse peripheral slots in the cylindrical, rotatable air motor housing, showing the abrasive sheet tensioning and holding member, with a sheet of abrasive material therein, and showing the toothed, hinged, spring tensioned holding device engaging a sheet of abrasive material.
Figure 13:
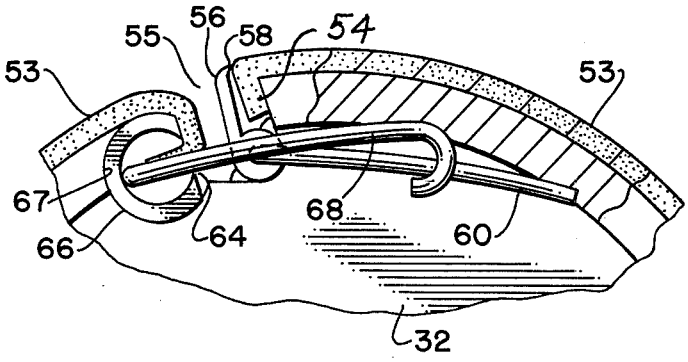
FIG. 13 is a view similar to FIG. 12, but of the opposite side of the cylindrical motor drum housing, with parts being broken away and shown in section to bring out the details of construction.

Rotatable cylindrical motor drum housing 3 has a recess 55 formed in a side thereof, as will best be seen in FIGS. 4, 5, 7, 12 and 13, whereby one end of a sheet of abrasive material 53 is anchored therein, as indicated at 54, by a spring pressed, toothed element 56, which toothed element is best seen in FIGS. 11, 12, and 13, with the teeth thereof engaging one end of the sheet of abrasive material by being pressed thereagainst by the torsion spring 60. The toothed element 56 has an apertured hinge portion H thereon and is hingeably mounted on the apertured lugs L on the cylindrical, rotatable motor drum housing 3, and has lever means 62 extending therefrom, within the confines of the housing 12, which lever means may be depressed to release the sheet of abrasive material 53.

The above described means of anchoring the sheet of abrasive material is similar in construction to the means shown in my co-pending application for U.S. patent application Ser. No. 536,020, ABRADING DEVICE, now U.S. Pat. No. 3,914,905.

Figure 10:
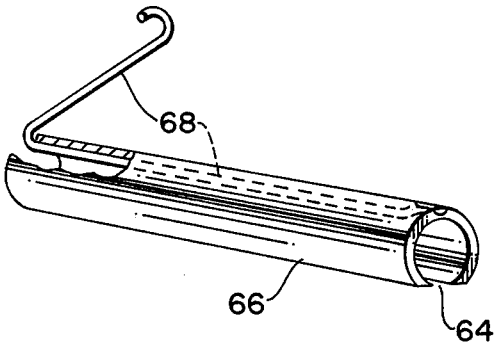
FIG. 10 is a perspective view, on an enlarged scale, of one of the abrading sheet tensioning and holding members, with parts broken away and shown in section, shown apart from the rest of the abrading device.

The sheet of abrasive material 53 is pulled tightly around the cylindrical drum housing 3, with an end thereof being inserted through a slot 64 into a partly cylindrical member 66, which member 66 is rotatable within a complementary cylindrical bore 67 by an outstanding spring 68, which spring exerts a torsional pressure thereon, as will best be seen in FIGS. 10 and 13. When the sheet of abrasive material 53 becomes worn or loosened, the torsion spring 68 will maintain the abrasive strip tight at all times, in the manner as set forth in the aforementioned application.

The motor driven abrasive device 1 has a knob handling means 70 on housing 12 thereof, so the device may be held by handle 72 and the knob 70 thereof for certain abrading operations, and by the handle 72 and knob 74 for other operations, as will be more fully brought out hereinafter.

The housing 12, in which the cylindrical motor drum housing 3 is rotatably mounted, has front and rear contour guide members, designated generally by the numerals 76 and 77, respectively, mounted on the housing 12 so as to enable certain contour or planar work to be done. A lever 80 is provided on portion 78 of housing 12 to raise and lower the cylindrical drum housing 3 with respect to the opening 82, formed between the contour guide members 76 and 77, to gauge the depth of engagement of the abrasive sheet 53 with the surface being abraded.

The lever 80 is mounted on a shaft 84, which shaft extends inwardly through housing portion 78 and has an outstanding lever 86 thereon which engages a recess 88 formed in housing 12. Upon movement of the lever 80, the housing portion 78 is moved relative to housing 12, which regulates to the depth at which the abrading drum 3, carrying the abrading element 53 engages with the surface being abraded. The lever 80 is secured to shaft 84 by means of a screw 90.

Upon upward movement of the lever 80, as shown in FIG. 5, to a position above the zero on indicia 92, which is formed on portion 78 of housing 12, the shaft 84 will be rotated so that the lever 86, connected thereto, will be moved out of recess 88, which will enable the disengagement of housing portion 78 from the housing 12. The rear portion of the housing portion 78 may be moved downward and the forward portion thereof may be moved forward to disengage housing portion 78 from a lug 79 on housing 12.

The above described structure enables the contour guide members 76 and 77 and housing portion 78 to be disconnected and removed from the main housing 12, to expose approximately two-thirds of the abrading surface of the cylindrical drum housing 3. In so doing the motor driven abrading device may be gripped by knob 70 and handle 72 to abrade in such places as would not be possible with the contour guide shields and the housing portion 78 in place.

Figure 2:
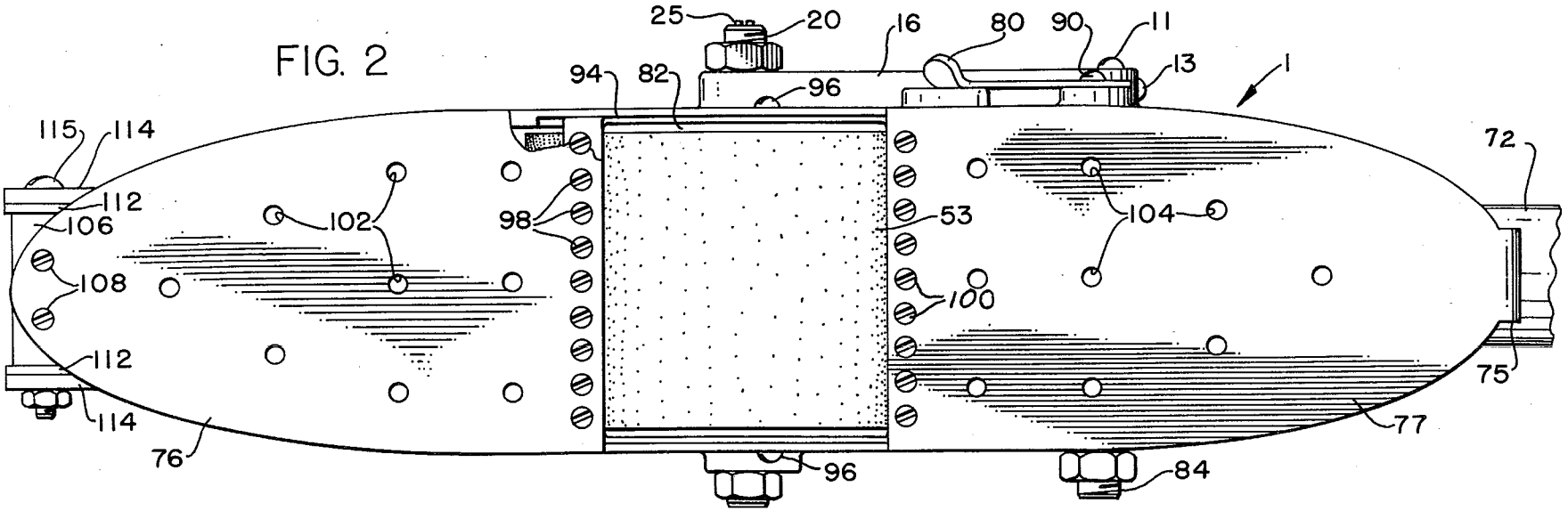
FIG. 2 is a bottom plan view of the abrading device, with parts broken away to enable the view to be shown on substantially the same scale as FIG. 1, other parts being broken away to show a portion of one of the transverse bars extending between the arcuately pivoted members and also to show the outer diameter of the abrading drum.
Figure 4:
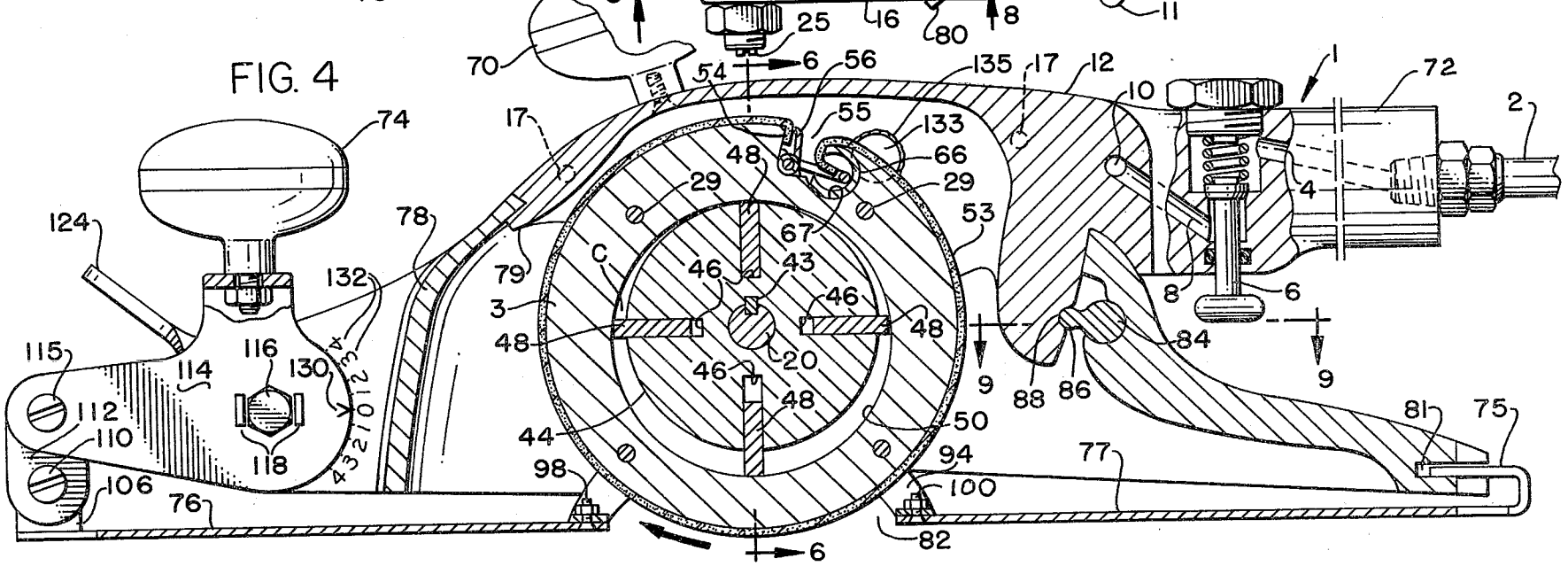
FIG. 4 is a sectional view taken on the line 4—4 of FIG. 3, looking in the direction indicated by the arrows, to show the details of construction of the abrading device and also to give a sectional view through the air motor and the air control valve to bring out the details of construction.

The two contour guides 76 and 77 are connected by an abridging arcuate member 94, which member 94 is pivotally connected to housing portion 78 by axially aligned pivot screws 96, with the contour guide members 76 and 77 being connected to arcuate abridging member 94 by a suitable fastening means, such as screws 98 and 100, as will best be seen in FIGS. 2 and 4.

The contour guides 76 and 77 are perforated with perforations 102 and 104, respectively. The forward end of contour guide member 76 is attached to an apertured lug 106 by fastening means, such as screws 108. A pivot member, such as bolt 110, passes through linkages 112 and apertured lugs 106 so as to provide for pivotal action between the lugs 106 and the linkages 112. An apertured lever 114 is pivotally mounted on a pivot means, such as a bolt 116, the outstanding portions of which lever is apertured to receive a pivot member or bolt 115 therethrough. The head of the bolt 116 is held against normal rotation by abutments 118. The other end of the pivot bolt 116 is screw threaded, as will best be seen in FIG. 3, which bolt 116 has a nut 120 threadably mounted thereon, the flats of which nut are positioned between abutments 122, so upon rotation of lever 124, the nut will be rotated to bindingly engage the face 126 of the lever 124, which face is complementary with a face 128 of lever 114. As wear is had between the faces 126 and 128, the lever 124 may be turned to remove nut 120 from bolt 116, and the nut 120 relocated, preferably one sixth of a turn tighter, which will change the position of lever 124 and enable the nut to be readily regulated by the thumb, while holding the handling knob 74, thus forming a second handling means, so as to regulate the contour guides 76 and 77 to pivot about pivot member 96, which enables reentrant portion 75 of the rear contour guide 77 to be moved back and forth in recess 81 in the housing portion 78. This will enable the lever 124 to be loosened and the handling knob 74 to be moved about the axis of pivot member or bolt 116, so the marker 130, on lever 114, will register with one of the indicia 132 to indicate whether contour guide members 76 and 77 are planar, if positioned at zero, or have a convex contour when positioned to one side of zero. The guide members 76 and 77 will be concave when moved to the opposite side of zero and the lever 124 tightened to maintain the contour guide members 76 and 77 in the desired position to form the desired contour.

Figure 3:
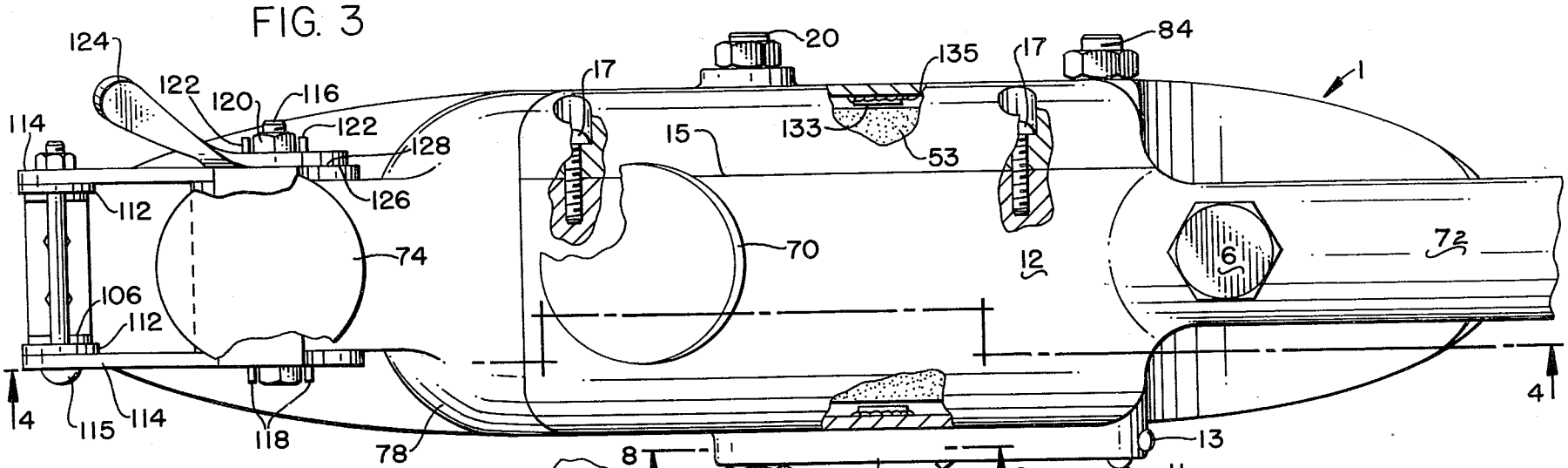
FIG. 3 is a top plan view of the air motor driven device with parts broken away to enable the scale of the drawing to agree with FIGS. 1 and 2, other parts being broken away and shown in section to bring out the details of construction.

The housing 12 is split longitudinally along a line 15, which housing portions are held together by screws 17 to make possible the disassembly and reassembly of the housing 12, as will be seen in FIG. 3. The inner side of each portion of the housing 12 has hardened metal or a composition element 133 secured thereto, as by welding or cementing, as indicated at 135, which element is in circumferential alignment with the abrasive sheet 53 to retain the abrasive sheet 53 against lateral movement with respect to cylindrical drum housing 3, as will best be seen in FIGS. 3 and 4.

The abrading device 1 has a housing 12 in which a shaft 20 is mounted, passed therethrough and is non-rotatable with respect thereto. A stator 44 is mounted on and keyed to shaft 20 by a key 43 to maintain the stator 44 non-rotatable with respect to the drum housing 12. The cylindrical drum housing 3 is journaled on bearings B on shaft 20 to rotate about the axis of the shaft 20 and is relatively movable vertically by lever 80 with respect to the contour guide members 76 and 77, when the contour guide members are in place.

The housing 12 is maintained in fixed, keyed relation to the shaft 20 by key K so as to insure that the housing 12 will not rotate with respect to shaft 20.

OPERATION

With the contour of contour guide members 76 and 77 properly set by lever 124, and locked in place on pivot screw bolt 116, the depth of abrading engagement of the abrasive sheet 53, secured to the cylindrical drum 3 is then regulated by lever 80, and with the abrading device gripped by handle 72 and knob 74, the abrading action will be performed by opening valve 6, which directs air from hose 2 through passage 4, valve 6, passages 8 and 10 into passage 14 and thence into annular passage 18, around shaft 20, and through diametrically cross drilled passage 22 to intersect axial hole 24, which hole 24 is plugged at one end thereof by screw threaded plug 25 to direct air into the cross drilled hole 34 in shaft 20 to direct air outward into annular groove 26 and thence upward through radial passage 36, which is plugged at the outer end thereof by a plug 38, into arcuate passage 40 which is in fluid communication with chamber C to react for approximately 90° against an adjacent face of one of the vanes 48, which will rotate the cylindrical drum housing 3 in the direction indicated by the arrows in FIGS. 1, 4 and 5, to perform an abrading action on the surface being abraded. The expansion of the air will cause the drum 3 to continue to rotate and the air, under pressure, will be exhausted through arcuate slot 52 for slightly less than 180° of the rotation. The vanes 48 are each fitted within a vane slot 46 of stator 44. Each of the vanes 48 has an arcuate or rounded portion on the inner end thereof so as to admit air, under pressure, from arcuate passage 42 beneath the ends of the vanes 48 to urge the vanes 48 outwardly into sealing relation with the inner surface 50 of the cylindrical drum housing 3. Pressure will be maintained below the vanes approximately 180° until the air starts exhausting from chamber C, after the vane has made a revolution of approximately 180°, the air will be completely exhausted from the space between the respective vanes 48 before it reaches the upper-most point at which air in introduced, to rotate the cylindrical drum 3.

FIGS. 10, 11, 12 and 13 show the manner by which the abrasive sheet 53 is inserted into a slot 64 and wrapped tightly around cylindrical drum 3, with the teeth 58 on toothed element 56 being fitted in place, and upon release of lever 63 a torsion spring 60 will bindingly engage an end of the abrasive strip or sheet, which is folded over a sharp corner, in the same manner as it is fitted into the cylindrical member 66 having a slot therein, and with the torsion spring 68 maintaining the abrasive sheet 53 against outward movement through slot 64.

Apertured lugs L are secured to a portion of the cylindrical drum housing 3 within recess 56 and complementally apertured portions H on toothed member 56 complementally interfit with apertured lugs L and with a torsion spring 60 forming a longitudinal pivot therethrough. The outwardly extending portion of the torsion spring 60 is in bearing engagement beneath a rim of the cylindrical drum 3, with the opposite end of the torsion spring 60 being engaged beneath operation lever 62 of toothed member 56. In this manner the toothed element 56 and cylindrical member 66 are within recess 55 below the circumferential surface of abrading sheet 53.

What is claimed is:

1. A motor driven abrading device, which device comprises;

a. a housing having at least one side thereof partially open, 1. a handle secured on said housing and forming a first handling means, b. an apertured, non-rotatable shaft mounted within said housing, 1. a stator mounted on said shaft and being fixed against rotation with respect thereto, c. a cylindrical, rotatable motor drum housing, having end plates thereon, journaled on said shaft for rotation about the axis thereof, and adapted to selectively extend through said at least one partially open side, 1. a sheet of abrasive material surrounding the periphery of said cylindrical, rotatable motor drum housing, 2. fastening means detachably securing each end of said sheet of abrasive material to said cylindrical, rotatable motor drum housing, d. said cylindrical, rotatable motor drum housing and said stator forming a motor, 1. a source of power connected to said motor for rotating said cylindrical, rotatable motor drum housing about an axis on which said abrading sheet is detachably secured.

2. A motor driven abrading device as defined in claim 1; wherein a. said motor is an air driven motor, b. said source of power, connected to said motor for rotating said hollow, cylindrical, rotatable motor drum housing, is air under pressure.

3. A motor driven abrading device as defined in claim 2 wherein a. said stator has circumferentially spaced, radial slots formed therein, each which slot receives a slidable vane therein, each which vane forms a seal between said stator and said hollow, cylindrical, rotatable motor drum housing.

4. An abrading device as defined in claim 1; wherein a. a housing portion is detachably engaged with said housing, b. lever and recess means normally being interengaged between said housing and said housing portion, 1. a manually operated lever connected to said lever engaging said recess means to cause relative movement between said housing and said housing portion, c. contour guide means connected to said housing portion which contour guide means has an opening formed therein intermediate the ends thereof to receive said hollow, cylindrical, rotatable motor drum housing therethrough, 1. said housing, mounting said cylindrical, rotatable motor drum housing being manually operable by said manually operated lever to maintain said motor drum housing within said opening in said contour guide means in adjusted relation with respect to the lower surface of said contour guide means.

5. An abrading device as defined in claim 4; wherein a. interengaging means interconnects said housing and said housing portion, b. said manually operated lever being adapted to move said lever and recess means to engage said housing and said housing portion when moved into one position and to disengage said housing and said housing portion when moved into another position.

6. An air driven motor, which motor comprises;

a. a first housing, which housing has air passages formed therein, b. an apertured, non-rotatable shaft mounted within said first housing, said aperture being connected to one of said passages, 1. a stator mounted on said shaft and being fixed against rotation with respect thereto, c. a hollow, cylindrical, rotatable motor drum housing, having end plates thereon, journaled on said shaft for rotation about the axis thereof, 1. said stator having circumferentially spaced, radial slots formed therein, each which slot receives a slidable vane therein, each which vane forms a seal between said stator and said hollow cylindrical, rotatable motor drum housing, 2. each said slidable vane, when in one position, forms a chamber between said hollow, cylindrical, rotatable motor drum housing and said stator to receive air under pressure thereinto, 3. one of said end plates having a first air inlet passage formed therein which air inlet passage is in fluid communication with one of said passages in said housing to direct air, under pressure, radially inward of said vanes for a predetermined arcuate travel, 4. one of said end plates having a second air inlet port formed therein and connecting to one of said passages in said housing to direct air under pressure into said chamber intermediate one of said vanes and the inner diameter of said hollow, cylindrical rotatable motor drum housing so that the reaction force of the air, under pressure, on said vane will cause said cylindrical, rotatable motor drum housing to rotate in a selected direction, 5. one of said end plates having an air outlet port formed therein in circumferentially spaced relation to said second air inlet port, so as to direct air under pressure from said chamber between one of said vanes and said cylindrical, rotatable motor drum housing, when said rotatable drum housing has moved through a predetermined arcuate movement, 6. a source of air under pressure directed into and through said inlet openings in said end plate to said stator, 7. valve means for controlling the flow of said air under pressure through said passages in said housing to said air inlet ports.

7. An air driven motor as defined in claim 6; wherein a. the one of said end plates which has said first air inlet passage formed therein is the same end plate which has said second air inlet passage formed therein and an air outlet port formed therein.

8. An air driven motor as defined in claim 6; wherein a. said vanes which are radially slidable in said stator, each said vane having an arcuate inner end surface to admit air under pressure radially inward of said vanes for a predetermined arcuate travel, b. the outer end of each said vane being of a shape to form a complementary seal with the inner diameter of the hollow, cylindrical, rotatable motor drum housing so as to form an air driven motor.

9. An air driven motor as defined in claim 6; wherein a. said hollow, cylindrical, rotatable motor drum housing has an abrading sheet mounted on the cylindrical surface thereof, b. means securing said sheet of abrading material to the periphery of said cylindrical, rotatably motor drum housing.

10. An air driven motor as defined in claim 9; wherein a. said first housing has laterally spaced apart abrasive sheet guide means secured to the inner surface of said housing a spaced distance outward from and in lateral alignment with said sheet of abrasive material on said motor drum housing.

1. said abrasive sheet guide means is of hardened material.

11. An air driven motor as defined in claim 6; wherein a. said source of air, under pressure, is connected in fluid communication with said apertured, non-rotatable shaft to direct air therethrough into said hollow, cylindrical, rotatable drum housing to direct air, under pressure, against at least one said vane to form said motor.

* * * * *